United States Patent [19]

Watabe

[11] Patent Number: 4,513,474

[45] Date of Patent: Apr. 30, 1985

[54] WEDGE HINGE HAVING AN AXIALLY MOVABLE PIVOT

[75] Inventor: Takaharu Watabe, Hirakata, Japan

[73] Assignee: Santo Industries Co., Ltd., Osaka, Japan

[21] Appl. No.: 441,913

[22] Filed: Nov. 15, 1982

[30] Foreign Application Priority Data

Aug. 27, 1982 [JP] Japan ..... 57-129968
Aug. 27, 1982 [JP] Japan ..... 57-129969

[51] Int. Cl.[3] ..... E05D 7/04

[52] U.S. Cl. ..... 16/243; 16/247; 16/248; 16/252; 16/382; 16/386; 16/DIG. 40; 24/538; 49/388; 269/234; 403/374

[58] Field of Search ..... 16/247, 249, 252, 382, 16/386, DIG. 40, 243, 248, 345; 49/388; 312/138 R, 324, 326; 160/199, 206; 403/374; 269/217, 234, 235; 24/492, 498, 516, 538, 544

[56] References Cited

U.S. PATENT DOCUMENTS

| | | | |
|---|---|---|---|
| 52,594 | 2/1866 | Parsons | 24/498 X |
| 1,790,610 | 1/1931 | Vindal | 24/538 X |
| 3,605,211 | 9/1971 | Grosz | 24/498 |
| 4,035,957 | 7/1977 | Roloff | 49/388 |

FOREIGN PATENT DOCUMENTS

| | | | |
|---|---|---|---|
| 215957 | 11/1909 | Fed. Rep. of Germany | 269/217 |
| 1160781 | 8/1958 | France | 16/252 |
| 1177698 | 4/1959 | France | 16/382 |

*Primary Examiner*—Fred A. Silverberg
*Attorney, Agent, or Firm*—Joseph W. Farley

[57] ABSTRACT

A hinge device comprising a main body in the form of a channel member, a mount pin projecting outward from the web of the main body, and a pressing plate pivoted at its one end to the inner side of one side wall of the main body and retractable into the channel of the main body, the pressing plate being provided with a wedge formation on one side surface thereof opposed to said one side wall of the main body so as to gradually approach the other side wall of the main body as the pressing plate is retracted into the channel of the main body. A plate, such as the closure plate of a cabinet, can be loosely fitted into the channel of the main body with the pressing plate withdrawn therefrom and can be tightly held in the channel by the wedging effect produced when the pressing plate is retracted. The hinge device can be installed in place easily and yet holds the plate reliably.

8 Claims, 8 Drawing Figures

WEDGE HINGE HAVING AN AXIALLY MOVABLE PIVOT

BACKGROUND OF THE INVENTION

The present invention relates to a hinge device, and more particularly to a hinge device suited for use with relatively small plates, such as the closure plates of cabinets.

Conventional hinges are attached to closure plates with screws and are therefore cumbersome to install. Further with hinges comprising a channel member and adapted to be fastened to a closure plate with screws with the closure plate fitted in the channel of the member, the hinge is liable to backlash unless the width of the channel accurately conforms to the thickness of the closure plate. Thus the hinges of this type have the drawback that they can not be used for closure plates other than those having a specified thickness.

Accordingly an object of the present invention is to provide a hinge device which is usable for plates somewhat varying in thickness, very easy to install and capable of retaining the plate reliably.

SUMMARY OF THE INVENTION

To fulfill this object, the present invention provides a hinge device comprising a main body in the form of a channel member, a mount pin projecting outward from the web of the main body, and a pressing plate pivoted at its one end to the inner side of one side wall of the main body and rectractable into the channel of the main body, the pressing plate being provided with a wedge formation on one side surface thereof opposed to said one side wall of the main body so as to gradually approach the other side wall of the main body as the pressing plate is retracted into the channel of the main body.

To attach the hinge device of the above construction to a plate, the plate is loosely fitted into the channel of the main body first, with the pressing plate pulled out, and the pressing plate is then retracted into the channel. Consequently the plate can be tightly held between the pressing plate and the other side wall of the main body by the resulting wedge effect. The hinge device is usable also for plates of different thicknesses when the amount of retraction of the pressing plate is adjusted.

Various features and advantages of the present invention will be readily understood from the following description of embodiments with reference to the accompanying drawings;

DESCRIPTION OF THE PREPARED EMBODIMENTS

Figure 1:
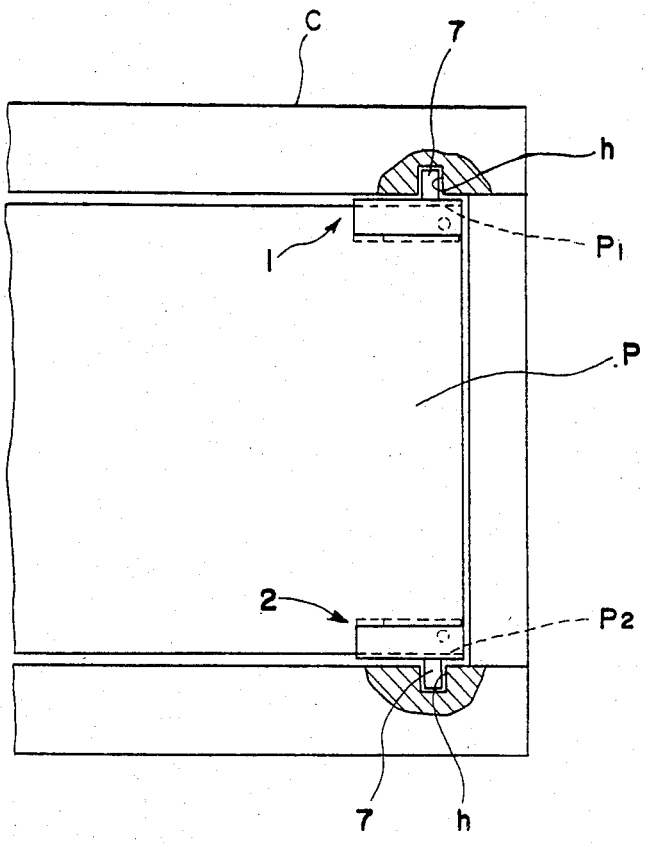
FIG. 1 is a front view showing a cabinet provided with two hinge devices according to the invention.

Throughout the drawings, like parts are referred to by like reference numerals.

Usually two hinge devices of the invention are used, for example, for a cabinet comprising a case C and a closure plate P for openably closing the opening of the case C as shown in FIG. 1.

Figure 3:
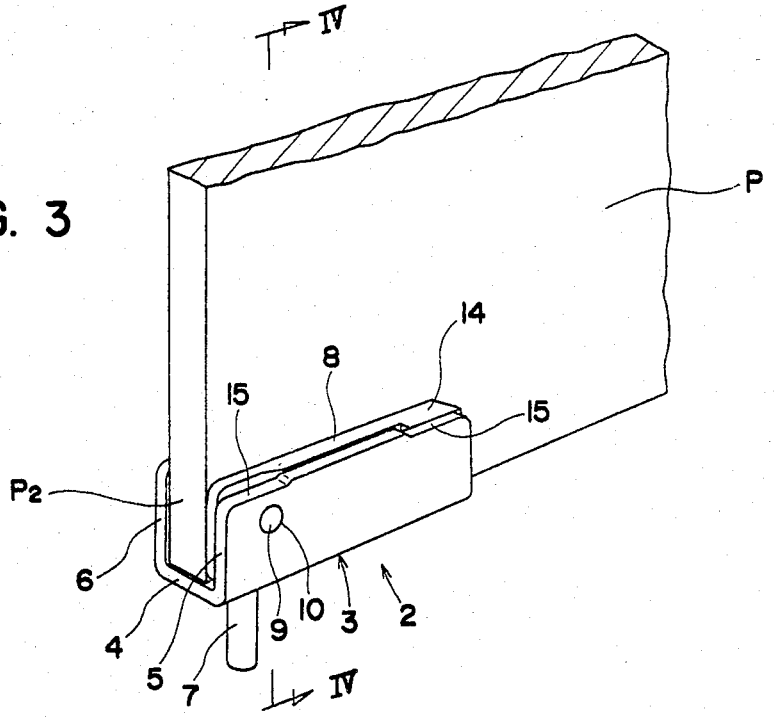
FIG. 3 is a perspective view showing only the lower hinge device as attached to a closure plate.
Figure 2:
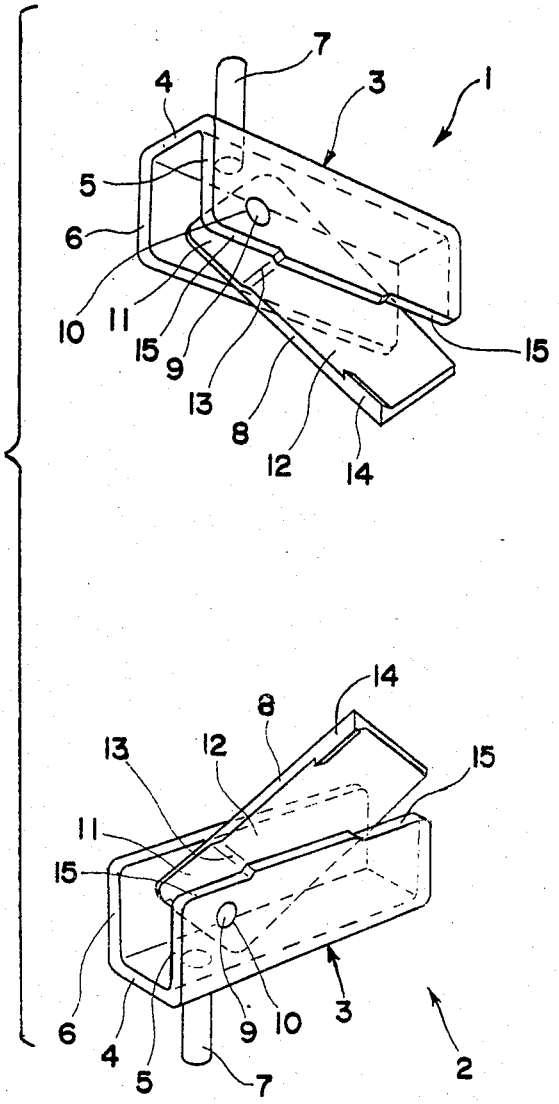
FIG. 2 is a perspective view showing two hinge devices according to a first embodiment of the invention and arranged vertically.
Figure 4:
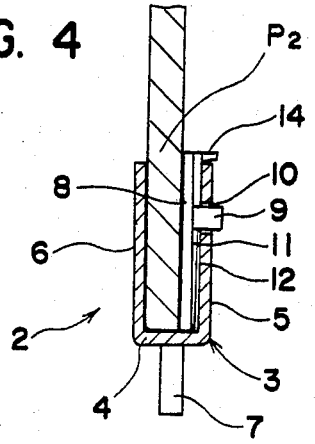
FIG. 4 is a view in section taken along the line IV—IV in FIG. 3.
Figure 5:
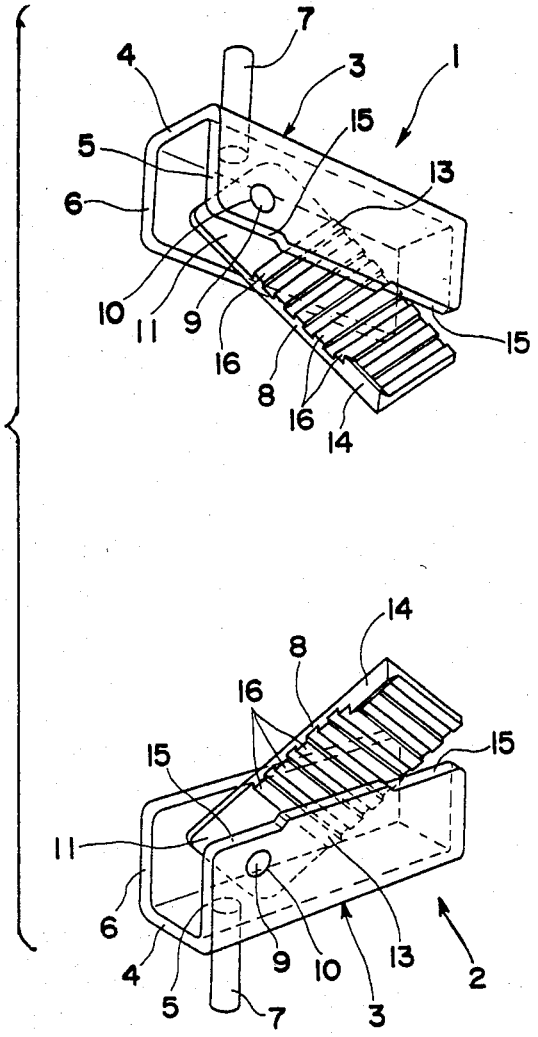
FIG. 5 is a view similar to FIG. 2 and showing two hinge devices according to a second embodiment of the invention.
Figure 6:
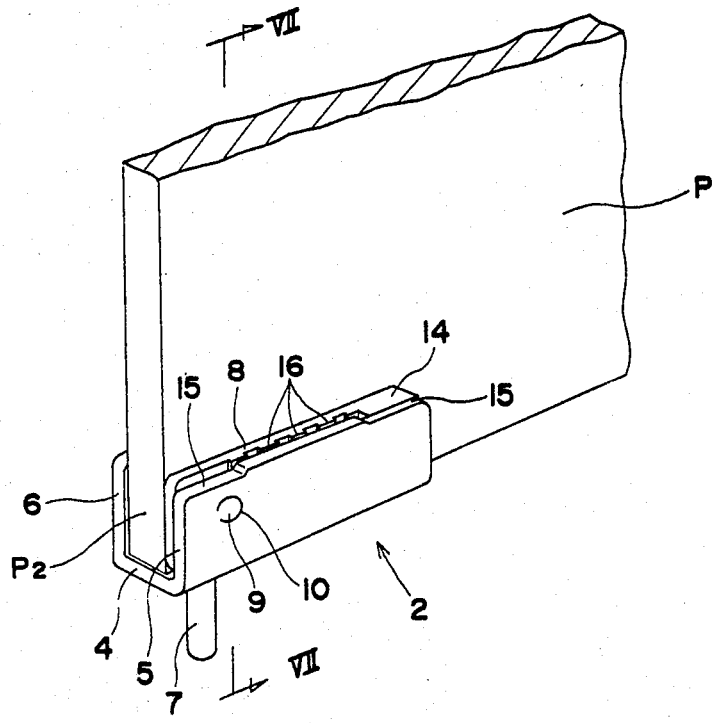
FIG. 6 is a perspective view showing only the lower hinge device as attached to a closure plate.
Figure 8:
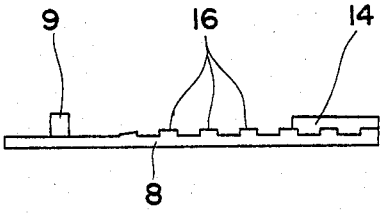
FIG. 8 is a bottom view showing a pressing plate included in the hinge device.
Figure 7:
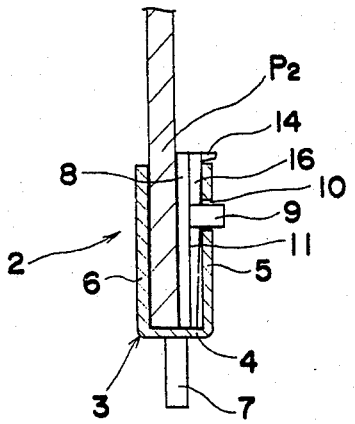
FIG. 7 is a view in section taken along the line VII—VII in FIG. 6.

FIGS. 2 to 4 show a first embodiment of the invention. To mount the rectangular closure plate P shown in FIG. 1 on the case C, it is necessary to use an upper hinge 1 to be attached to an upper corner $P_1$ of the closure plate P and a lower hinge 2 to be attached to a lower corner $P_2$ of the plate P and symmetric with the upper hinge 1 with respect to a plane. Each hinge 1 or 2, for example, the lower hinge 2 comprises a main body 3 in the form of a channel member composed of a web 4 and side plates 5, 6, a mount pin 7 projecting outward from the web 4 of the main body and positioned close to one end thereof, and an approximately rectangular pressing plate 8 pivoted at its one end to the inner side of the side wall 5 of the main body 3 and retractable into the channel of the main body 3.

More specifically the pressing plate 8 is formed, in the vicinity of its one end, with a pivot 9 projecting from one side surface thereof opposed to the side wall 5. The pivot 9 is fitted in a hole 10 formed in the side wall 5 in the vicinity of one end thereof and is slightly movable axially thereof. One end portion 11, providing the pivot 9, of the above-mentioned side surface of the pressing plate 8 is planar and parallel to the side wall 5. The remaining portion 12 of the side surface is in the form of a planar surface which is projected beyond the plane 11 and so inclined as to approach the plane 11 as it extends downward, thus providing a wedge formation. The other side surface of the pressing plate 8 is planar and parallel to the surface 11 and to the side wall 6. Accordingly the inclined surface 12 approaches the other side surface of the pressing plate 8 as it extends downward. A slanting surface 13 is formed between and continuous with the surfaces 11 and 12. When the pressing plate 8 is withdrawn from the main body 3 to a position at a right angle therewith, the surface 11 is partly projected beyond the upper edge of the side wall 5. A knob projection 14 is formed at the upper corner of the other end of the pressing plate 8. The knob projection 14 is received in one of cutouts 15 formed at the upper opposite corners of the side wall 5.

To attach the lower hinge device 2 of the above construction to the closure plate P, the lower corner $P_2$ of the closure plate P is loosely fitted into the space between the side walls 5, 6 of the main body 1 first, with the pressing plate 8 withdrawn to the position at a right angle with the main body 3 and further with the surface 11 of the pressing plate 8 in contact with the side wall 5. Subsequently the pressing plate 8 is progressively pushed into the space between the lower corner $P_2$ of the closure plate P and the side wall 5 by moving the knob projection 14 by hand. This causes the wedge formation 12 to coact with the side wall 5, translating the pressing plate 8 toward the side wall 6 to tightly hold the lower corner $P_2$ of the closure plate P between the pressing plate 8 and the side wall 6. The step between the surface 11 and the wedge formation 12 is smoothed with the slanting surface 13 and therefore will not act against the retraction of the pressing plate into the main body 1. Furthermore the pivot 9, which is axially movable, will not hinder the translation of the pressing plate 8, become damaged or distort the end portion 11 of the pressing plate 8.

The upper hinge device 1 can be similarly attracted to the upper corner $P_1$ of the closure plate P.

The closure plate P having the pair of hinge devices 1 and 2 thus attached thereto can be supported rotatably by the case C when the case C is assembled, by fitting the mount pins 7 of the devices 1 and 2 into holes h formed in the case C. Alternatively the hinge devices 1 and 2 may be mounted on the case C after assembly and thereafter caused to support the closure plate P.

The closure plate P is easily removable from the hinge devices 1 and 2 by inserting a screwdriver or the like into the cutout 15 beneath the knob projection 14, slightly prying up the pressing plate 8 and thereafter withdrawing the pressing plate 8 fully by hand.

FIGS. 5 to 8 show a pair of hinge devices 1 and 2 according to a second embodiment and also symmetric with respect to a plane. The lower hinge device 2 has the same construction as the lower hinge device 2 of the first embodiment except that the former has a wedge formation which is provided by a plurality of ridges. More specifically the side surface of a pressing plate 8 opposed to one side wall 5 of a main body 3, except for one end portion 11 providing a pivot 9, is formed with a plurality of ridges 16 spaced apart and extending traversely of the pressing plate 8. The crests of the ridges 16 are so inclined as to approach the other side surface of the pressing plate 8 as they extend downward. The crest of the ridge 16 in the closest proximity to the pivot 9 is made continuous with the surface 11 by a slanting surface 13. The ridges 16 need not extend over the entire width of the pressing plate 8.

While the hinge devices 1 and 2 of the second embodiment can be removably attached to a closure plate P in the same manner as those of the first embodiment, the pressing plate 8 of the second embodiment is retractable and withdrawable with reduced friction and therefore with greater ease because the wedge formation is provided by the ridges 16.

What is claimed is:

1. A hinge device comprising a main body in the form of a channel member having two parallel side walls and a web connecting said side walls, a mount pin projecting outward from said web, and a pressing plate having oppositely facing side surfaces, said pressing plate being connected adjacent to one of its ends to one of said side walls by an axially slidable pivot and being pivotally retractable into said channel member between said side walls, said pressing plate being provided with a wedge formation on the one of said side surfaces opposed to said one side wall, the other of said side surfaces of the pressing plates being planar and parallel to the other side wall of said channel member, said wedge formation being adapted in response to pivotal retraction of said pressing plate into said channel member to coact with said one side wall and translate said pressing plate toward the other side wall of said channel member, said other planar side surface of said pressing plate gradually approaching said other side wall in subtantially parallel relation therewith.

2. A hinge device as defined in claim 1 wherein said one side surface of said pressing plate has an end portion adjacent to said pivot and a remaining portion, said end portion being planar and parallel to said other side surface of said pressing plate, and said wedge formation being provided on said remaining portion.

3. A hinge device as defined in claim 2 wherein said wedge formation comprises a planar surface which projects outwardly of said planar end portion of said one side surface of said pressing plate and which is inclined toward said other side surface of said pressing plate in the direction of pivotal retraction thereof.

4. A hinge device as defined in claim 3 wherein said one side surface of said pressing plate includes a slanting surface formed between and continuous with said planar end portion and said planar inclined surface of said wedge formation.

5. A hinge device as defined in claim 2 wherein said wedge formation comprises a plurality of spaced-apart ridges projecting outwardly of said planar end portion and extending transversely of said pressing plate, said ridges having crests inclined toward said other side surface of said pressing plate in the direction of pivotal retraction thereof.

6. A hinge device as defined in claim 5 wherein said one side surface of said pressing plate includes a slanting surface extending between and continuous with said planar end portion and the crest of the one of said ridges in closest promimity to said pivot.

7. A hinge device as defined in claim 1 wherein said pressing plate includes an edge portion positioned away from said web of said channel member, and a knob projection is formed on said edge portion.

8. A hinge device as defined in claim 7 wherein a cutout for receiving said knob projection is formed in said one side wall of said channel member.

* * * * *